United States Patent [19]

Ziesel et al.

[11] Patent Number: 4,904,418

[45] Date of Patent: Feb. 27, 1990

[54] MOTORLESS CARBONATOR PUMP WITH GAS SAVING DEVICE

[75] Inventors: Lawrence B. Ziesel, Marietta; Robert D. Hughes, Atlanta, both of Ga.

[73] Assignee: The Coca-Cola Company, Atlanta, Ga.

[21] Appl. No.: 330,366

[22] Filed: Mar. 29, 1989

[51] Int. Cl.[4] ..... B01F 3/04

[52] U.S. Cl. ..... 261/35; 261/82; 261/DIG. 7

[58] Field of Search ..... 261/35, DIG. 7, 81, 261/82

[56] References Cited

U.S. PATENT DOCUMENTS

| | | | |
|---|---|---|---|
| 352,387 | 11/1886 | Banks . | |
| 484,383 | 10/1892 | Weatherhead . | |
| 613,376 | 11/1898 | Koenig et al. | 261/81 |
| 2,604,310 | 7/1952 | Brown | 261/82 |
| 3,752,452 | 8/1973 | Iannelli . | |
| 3,756,576 | 9/1973 | Tremolada | 261/35 |
| 4,808,349 | 2/1989 | Rudick | 261/82 |

*Primary Examiner*—Tim Miles

*Attorney, Agent, or Firm*—Birch, Stewart, Kolasch & Birch

[57] ABSTRACT

A motorless carbonator including a single acting pneumatic water pump connected between a carbonator tank and an uncarbonated water supply with the pump having a gas return spring integral therewith. The pump is driven by the carbon dioxide ($CO_2$) fed to the carbonator tank. A $CO_2$ saving device is coupled between the water pump and the carbonator tank and includes a spring biased diaphragm connected to a piston rod and an O-ring support member which operates to control the venting of $CO_2$ to the atmosphere so as to reduce the amount of $CO_2$ required to operate the pump during both a pumping stroke and a return stroke.

11 Claims, 1 Drawing Sheet

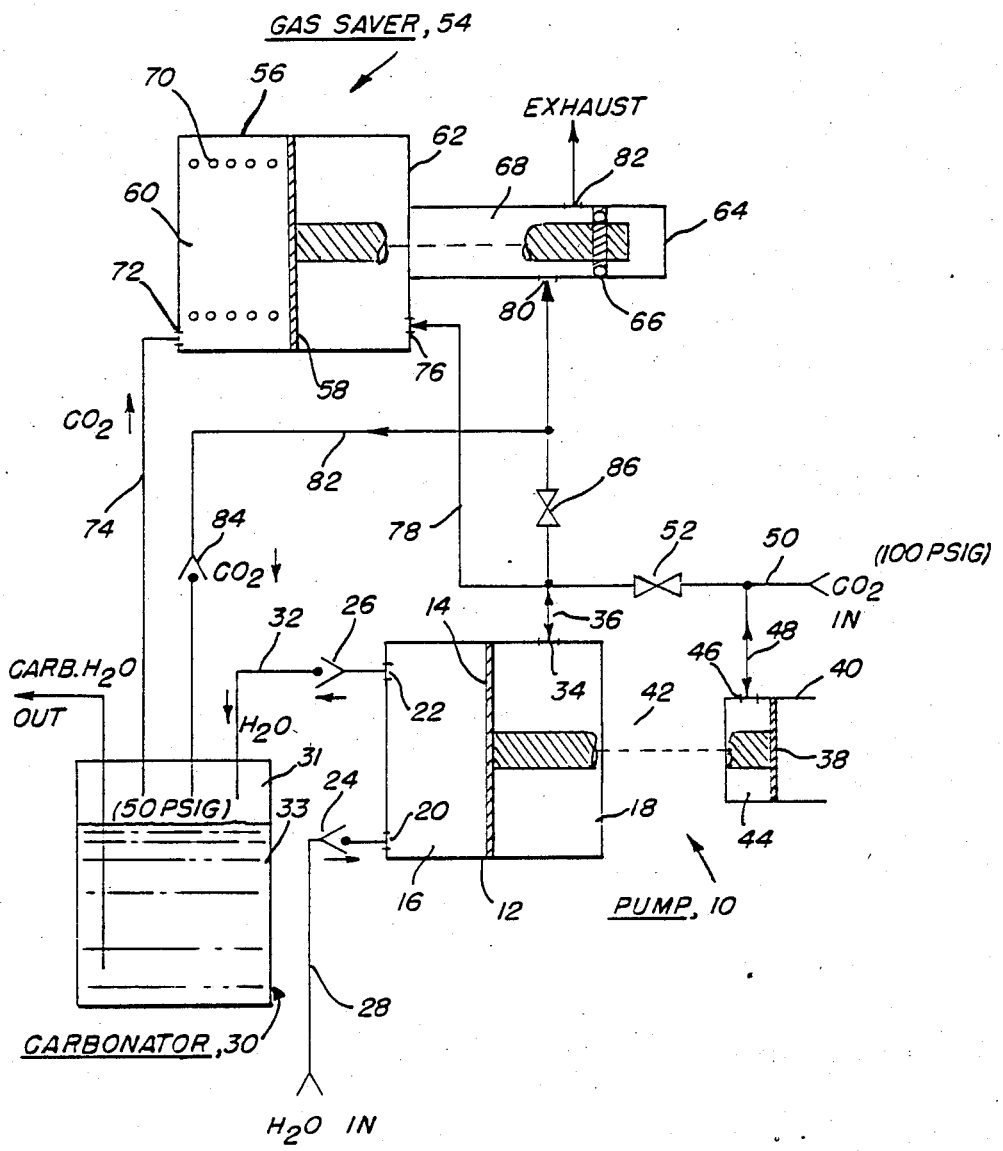
GAS SAVER, 54
70
56
EXHAUST
62
68
82
60
64
72
80
66
58
76
$CO_2$
82
86
74
84
78
52
50
(100 PSIG)
$CO_2$
$CO_2$
IN
32
26
14
36
48
CARB. $H_2O$
OUT
46
40
22
34
42
$H_2O$
31
38
24
(50 PSIG)
33
20
18
44
16
12
PUMP, 10
28
CARBONATOR, 30
$H_2O$ IN

MOTORLESS CARBONATOR PUMP WITH GAS SAVING DEVICE

BACKGROUND OF THE INVENTION

This invention relates generally to carbonating apparatus for use in connection with post-mix beverage dispensing systems and more particularly to a pneumatically driven pump system for delivering water to a carbonator tank.

Various types of apparatus for making and dispensing carbonated water for a post-mix dispensing system are generally known. Such apparatus normally falls into two categories, one being a motor driven pump type carbonator assembly, while the other comprises a motorless or pneumatic pump driven assembly. In a motor driven carbonator, the water in a carbonator tank is mixed with carbon dioxide gas from a pressurized source and the water level in the tank is sensed and a pump motor is turned on and off to deliver uncarbonated or still water into the tank depending upon the sensed level. A motorless water delivery system uses a pneumatic pump, for example. Typically, such a pump includes a double acting or a dual ended piston assembly which is reciprocated to pump water into the carbonator depending upon the level of the water present in the carbonator tank. In each instance, the carbonated water is then fed to a dispensing valve where the carbonated water is mixed with a measured amount of beverage concentrate or syrup to provide a carbonated beverage.

SUMMARY OF THE INVENTION

It is an object of the present invention, therefore, to provide an improved apparatus for making and dispensing carbonated water.

It is a further object of the invention to provide an improved apparatus for dispensing carbonated water in a post-mix beverage dispenser.

It is yet another object of the invention to provide improvement in a motorless carbonator unit for a post-mix beverage dispenser.

And yet a further object of the invention is to provide an improvement in a carbonator for a carbonated beverage dispenser utilizing a pneumatically driven water pump.

And still a further object of the invention is to provide a pneumatically driven water pump in a carbonator which utilizes the carbonating gas as the power source for the pump.

The foregoing and other objects are realized by a motorless carbonator including a single acting pneumatic water pump connected between a carbonator tank and an uncarbonated water supply with the pump having a gas return spring integral therewith. The pump is driven by the carbon dioxide ($CO_2$) fed to the carbonator tank. A $CO_2$ saving device is coupled between the water pump and the carbonator tank and includes a spring biased diaphragm connected to a piston rod and piston which operates to control the venting of $CO_2$ to the atmosphere so as to reduce the amount of $CO_2$ required to operate the pump during both a pumping stroke and a return stroke.

BRIEF DESCRIPTION OF THE DRAWING

A more complete understanding of the invention will be had by referring to the following detailed description when taken in conjunction with the accompanying drawing wherein:

The figure is a mechanical schematic diagram illustrative of the preferred embodiment of the invention.

DETAILED DESCRIPTION OF THE INVENTION

Referring now to the drawing, reference numeral 10 denotes a single acting water pump having a gas spring return and which includes a pump housing 12 having a diaphragm or piston element, shown herein as a diaphragm 14 which separates a water pumping chamber 16 and a carbon dioxide ($CO_2$) power driving chamber 18. The water pumping chamber 16 includes a water inlet port 20 and an output port 22 respectively connected to a pair of check valves 24 and 26. The input check valve, moreover, is coupled to a water input feed line or conduit 28 coupled to a source of uncarbonated or still water, not shown. The output port 22 and the check valve 26 are connected to the interior of a conventional carbonator tank 30, utilized in connection with a post-mix carbonated beverage dispenser, by means of an output feed line or conduit 32. The gas driving chamber 18 includes a common input/output gas port 34 which connects to a $CO_2$ gas line 36.

Further as shown, the diaphragm 14 of the pump housing 12 is connected to the diaphragm or piston element 38 of a gas spring member 40 by means of a connecting rod 42. A closed gas spring chamber 44 of the return spring member 40 includes a common input-/output port 46 which is connected to a gas line 48 which in turn is connected to an input $CO_2$ feed line 50. The line 50 is connected back to a relatively high pressure (100 psig) source of gaseous $CO_2$ not shown. A first control valve 52 is also connected between the gas lines 36 and 48 which are respectively connected to the power driving chamber 18 and the return spring chamber 44.

A $CO_2$ saving device 54 is also shown in the drawing and comprises the combination of a housing 56, a spring biased diaphragm 58 separating two $CO_2$ gas chambers 60 and 62, as well as a venting chamber 64 in which is located a slidable O-ring support member 66. The O-ring support member 66 is fixed to an elongated piston rod 68 which connects back to the diaphragm 58. The gas chamber 60 includes a compression spring member 70 which contacts the back side of the diaphragm 58. It also includes a gas inlet port 72 which is coupled to the internal pressure of the head space 31 of the carbonator tank 30 by means of a gas line 74.

The adjoining gas chamber 62 in front of the diaphragm includes a gas inlet port 76 which is coupled back to the pump chamber 18 and the first control valve 52 by means of a gas line 78. The elongated chamber 64 further includes a vent inlet port 80 and a pump exhaust outlet port 82 located in the vicinity of the O-ring member 66 for reasons which will become apparent hereinafter when the description of operation is considered. The diaphragm 58 being attached to the piston rod 68 acts to enable and inhibit the flow of $CO_2$ between the vent port 80 and the exhaust port 82 in response to the differential in gas pressure acting on the diaphragm 58.

Both the pump chamber 18 and the head space 31 of the carbonator tank 30 are coupled to the vent port 80. The vent port 80 is connected to the head space 31 of the carbonator tank 30 through a gas line 82 and a one-way check valve 84. The pump chamber 18 is connected to the vent port 80 by means of a second control valve 86.

Considering now the operation of the embodiment shown in the drawing, during a pumping cycle, the valve 52 is opened while valve 86 is closed. The source pressure of, for example, 100 psig of $CO_2$ is fed into the port 34 of the pump chamber 18, causing the diaphragm 14 to move to the left, which causes the uncarbonated water in the chamber 16 to be forced out of the port 22 into the carbonator tank 30. Due to the fact that the gas line 78 is commonly connected to the valve 52 along with the gas line 36 to the pumping chamber 18, the source pressure of the $CO_2$ gas is also fed into the chamber 62 of the gas saving device 54 which causes the diaphragm 58 to also move to the left against the resistance of the compression spring 70 and the gas pressure in the head space 31 which is in the order of, for example, 50 psig. This also causes the piston 66 to move to the left between the vent port 80 and the exhaust port 82, thus preventing any $CO_2$ in the apparatus from being vented to the atmosphere.

During the return cycle, control valve 52 is closed while the valve 86 is opened. The relatively high source pressure on the rear side of the diaphragm 14 in the pump chamber 18 is now vented into the carbonator head space 31 through the gas line 82, as well as into the chamber 62 via the gas line 78. Since the head space pressure is coupled into the chamber 60 via the gas line 74, when the pressure is equalized in the chambers 60 and 62, the bias spring 70 forces the diaphragm back to the right. This opens the vent port 80 to the atmosphere via the exhaust port 82 due to the movement of the piston 66 to the right beyond the exhaust port 82.

It can be seen that a relatively smaller gas spring 40 is utilized in connection with the relatively larger water pump. Of significant value is the fact that the $CO_2$ in return gas spring chamber 44 is never vented to the atmosphere through the exhaust port 82. Instead, the $CO_2$ gas in the return spring chamber 44 is transferred into the main pumping chamber 18 when the control valve 52 opens and the control valve 86 closes.

Alternate operation of the two control valves 52 and 86 is accomplished, for example, by a bistable device, either mechanical or electrical, actuated or triggered as long as the level of carbonated water 33 in the carbonator tank 30 remains below a predetermined level as determined by level sensing apparatus, not shown.

Savings in $CO_2$ consumption from the source is realized due to the fact that the diaphragm 14 of the pump section 10 is larger in area than the diaphragm 38 of the gas return spring 40. Even though both elements 14 and 38 are acted upon by equal gas pressure, i.e. the gas pressure from the $CO_2$ source, but since force is equal to pressure times area, the pump diaphragm 14 will move to the left due to the greater force applied thereto. The movement of the diaphragm 38 to the left due to the connection of the piston rod 42 causes the $CO_2$ in the chamber 44 to be transferred into the pump chamber 18. This operation self primes the pump and therefore can be used with non-pressurized water or syrup. The combination of the pump 10 and gas saving device 54 allows the carbonator to use up to 50% of the $CO_2$ that would otherwise be wasted, since the $CO_2$ gas transferred from the return spring 40 into the pump chamber 18 is transferred partially, at least, into the carbonator tank 30 and into the chamber 62 of the gas saver device 54.

Having thus shown and described what is at present considered to be the preferred embodiment of the invention, it should be noted that the same has been made by way of illustration and not limitation. Accordingly, all alterations, changes and modifications coming within the spirit and scope of the invention as set forth in the appended claims are herein meant to be included.

We claim:

1. Carbonator pump apparatus, comprising:

a single acting motorless pump having both a pumping cycle and a return cycle and including a water pump chamber and a gas activated drive chamber separated by a pumping member, said pumping member being connected to gas return spring means having a gas activated drive chamber including a spring member, a carbonator tank having a head space therein and including a carbonating gas inlet means and carbonating gas outlet means;

gas saving means including a vent port coupled between said pump and said carbonator tank for controlling the venting of gas from said drive chamber of said pump during said return cycle;

a first gas control valve connected between said drive chamber of said return spring means and said drive chamber of said pump and being open during said pumping cycle and closed during said return cycle, means for connecting a source of carbonation gas to said drive chamber of said return spring means and said first control valve, said first control valve when open during said pumping cycle delivering gas to said drive chamber of said pump from both said source and said drive chamber of said return spring means to pump water from said pump chamber;

means for coupling gas during both said cycles between said drive chamber of said pump and said gas saving means;

a second gas control valve connected between said pump drive chamber and said gas inlet means of said carbonator tank and said vent port and being open during said return cycle to deliver gas from said pump chamber to said carbonator tank and said gas saving means and being closed during said pumping cycle; and means for coupling gas between said gas outlet means of said carbonator tank and said gas saving means.

2. The apparatus of claim 1 wherein said pumping member and said spring member each comprises a diaphragm or a piston.

3. The apparatus of claim 1 wherein said pumping member includes a surface area greater than the surface area of said spring member.

4. The apparatus of claim 1 wherein said gas saving means further comprises:

a first and second gas chamber separated by a first movable member, said first chamber being connected to said head space and said second chamber being connected to said drive chamber of said pump, a compression spring member in said first chamber biasing said first movable member in a direction opposite to that of the pumping member during a pumping cycle, a gas venting chamber having a vent inlet port, an exhaust outlet port, and a second movable member connected to said first movable member.

5. Carbonator pump apparatus, comprising:

a single acting motorless pump including a water pump chamber and a gas activated drive chamber separated by a pumping member, said pumping member being connected to a gas return spring having a gas activated drive chamber closed at one end by a spring member, a carbonator tank including a carbonating gas inlet line and a carbonating gas outlet line;

a gas saving device including a first and second gas chamber separated by a first movable member, a compression spring member in said first chamber biasing said first movable member in a predetermined direction, a gas venting chamber having a vent inlet port, an exhaust outlet port, and a second movable member connected to said movable member of said gas saving device for normally inhibiting the flow of gas between said inlet and outlet ports;

a first gas control valve connected between said drive chamber of said return spring and said drive chamber of said pump, means for connecting a source of carbonation gas to said drive chamber of said return spring and said first control valve;

a gas line coupled between said drive chamber of said pump and said second gas chamber of said gas saving device;

a second gas control valve connected between said pump drive chamber and said gas inlet line of said carbonator tank and said vent inlet port; and a gas line coupled between said gas outlet line of said carbonator tank and said first chamber of said gas saving device.

6. The apparatus of claim 5 wherein said pumping member and said gas return spring member each includes a diaphragm or a piston.

7. The apparatus of claim 5 wherein said pumping member and said return spring member each include a predetermined surface area and wherein the surface area of said pumping member is greater than the surface area of said gas return spring member.

8. The apparatus of claim 5 wherein said first movable member of said gas saving device comprises a diaphragm and said second movable member thereof comprises an O-ring support member.

9. The apparatus of claim 8 wherein said diaphragm and said O-ring support member are connected by a rod member.

10. The apparatus of claim 5 wherein said first and second control valves have mutually opposite open and closed operating states.

11. The apparatus of claim 10 wherein said pump has a pumping cycle and a return cycle and wherein said first control valve is open during said pumping cycle and said second control valve is open during said return cycle.

* * * * *